US007909048B2

(12) United States Patent
Chmelik Martinec

(10) Patent No.: US 7,909,048 B2
(45) Date of Patent: Mar. 22, 2011

(54) PNEUMATIC UMBRELLA

(76) Inventor: Andres Eduardo Chmelik Martinec, Buenos Aires (AR)

( * ) Notice: Subject to any disclaimer, the term of this patent is extended or adjusted under 35 U.S.C. 154(b) by 144 days.

(21) Appl. No.: 11/922,867

(22) PCT Filed: Jun. 29, 2005

(86) PCT No.: PCT/US2005/022890

§ 371 (c)(1),
(2), (4) Date: Dec. 26, 2007

(87) PCT Pub. No.: WO2007/004998

PCT Pub. Date: Jan. 11, 2007

(65) Prior Publication Data

US 2009/0223544 A1 Sep. 10, 2009

(51) Int. Cl.
*A45B 19/02* (2006.01)

(52) U.S. Cl. ..... 135/20.2

(58) Field of Classification Search ..... 135/20.2, 135/20.3; 137/625.67, 625.68, 861, 237; 251/325

See application file for complete search history.

(56) References Cited

U.S. PATENT DOCUMENTS 1,397,789 A * 11/1921 Stonestreet ..... 135/20.2
1,411,560 A * 4/1922 Beaty ..... 135/20.2
2,049,380 A * 7/1936 Huber ..... 135/16
2,625,946 A * 1/1953 Kaston et al. ..... 135/20.2
2,736,329 A * 2/1956 Cornellier ..... 135/20.2
2,753,878 A * 7/1956 Halberstam ..... 135/20.2
3,361,145 A * 1/1968 Jones ..... 135/20.2
3,672,567 A * 6/1972 Joesting ..... 236/1 C
3,706,160 A * 12/1972 Deibert ..... 47/23.2
3,863,661 A * 2/1975 Aburto ..... 135/20.2
3,954,117 A * 5/1976 Wallace ..... 135/20.2
4,747,422 A * 5/1988 Chung ..... 135/20.2
4,766,920 A * 8/1988 Grady, II ..... 135/20.2
5,103,848 A * 4/1992 Parsons ..... 135/20.2
6,913,030 B1 * 7/2005 Chmelik Martinec ..... 135/20.2

* cited by examiner

*Primary Examiner* — David Dunn
*Assistant Examiner* — Noah Chandler Hawk
(74) *Attorney, Agent, or Firm* — Defillo & Associates, Inc.; Evelyn A. Defillo

(57) ABSTRACT

An umbrella with pneumatic activation, specifically a portable, foldable umbrella, for the protection of persons from the rain and sun, and to be employed in fixed installations of one or more umbrellas as well, to protect crops, objects, or surfaces that require controlled protection, outdoor tables, beaches, and patios as principal examples of operation and use with individual or centralized control. When connected together, a group of umbrellas are controlled with a unified command, or through an automated system with temperature and water sensors. An automatic compressor could be provided to activate and deactivate the system, and it also could be activated within a closed circuit with a pressurized air storage chamber. A pneumatic umbrella that, in addition to the handle, or base, has a complete pneumatic circuit with entry and exit of air, equipment for pumping the air, a valve controlling the flow of air to either open or close the umbrella through internal conduits which are connected to extendable stems and are held together by a threaded system.

6 Claims, 4 Drawing Sheets

PNEUMATIC UMBRELLA

CROSS REFERENCE TO RELATED APPLICATION

This application is a national stage of PCT/US2005/022890 filed Jun. 29, 2005, under the International Convention.

FIELD OF THE INVENTION

The present invention refers to a pneumatically activated umbrella, specifically to a portable, foldable umbrella, for the protection of persons from rain and sun, and to be employed in fixed installations of one or more umbrellas, furthermore to protect crops, objects, or surfaces that require controlled protection, outdoor tables, beaches, and patios as exemplary uses with individual or centralized control that, connected together, controls a group of umbrellas with a unified command, or through an automated system with temperature and water sensors. Moreover, an automatic compressor could be provided to activate and deactivate the system, and it also could be activated within a closed circuit with a pressurized air storage chamber.

The object of the proposed invention is to disclose a pneumatic umbrella that, in addition to the handle, or base, has a complete pneumatic circuit with entry and exit of air, equipment for pumping air, a directional valve controlling the flow of air to either open or close the umbrella through internal conduits installed in the fabric which are connected to extendable stems and are held together by means of a threaded system.

BACKGROUND OF THE INVENTION

A great number of embodiments are known in the art of making umbrellas and parasols. In all of them, they offer various solutions to the folding and require a great number of small, articulated parts and pieces, which in general are not long lasting.

The present invention, on the other hand, provides protection with a minor number of articulated parts, with a flexible mushroom-shaped hemisphere without mechanical parts.

Manufactured is thereby simplified and longer life guaranteed, compared to the life of articulated mechanical and flexible parts that carry out the same function.

SUMMARY OF THE INVENTION

The present invention proposes a pneumatically activated umbrella for fixed installations of one or more equipment pieces, to protect crops, objects, or surfaces that require controlled protection, outdoor tables, beaches, and patios as exemplary uses with individual or centralized control that, connected together, controls a group of umbrellas with a unified command, or through an automated system with temperature and water sensors. Furthermore, an automatic compressor could be provided to activate and deactivate the system.

The proposed umbrella comprises rigid sliding parts, each of which supports the others upon extending, providing an axis or column, having other more flexible parts, all of which together constitute a hemisphere or mushroom head, through the action of a pneumatic circuit, with which it is equipped, by means of a manually-operated pump, which is controlled by a specifically designed valve, activated by a command switch for compression, stopping and decompression of the pneumatic system. This allows the unfurling of the rigid parts that make up the axis column and the flexible parts that make up the hemisphere or mushroom head, hold them together, and later fold them.

DESCRIPTION OF THE PREFERRED EMBODIMENTS

Figures 1, 2, 4, 5, 7:
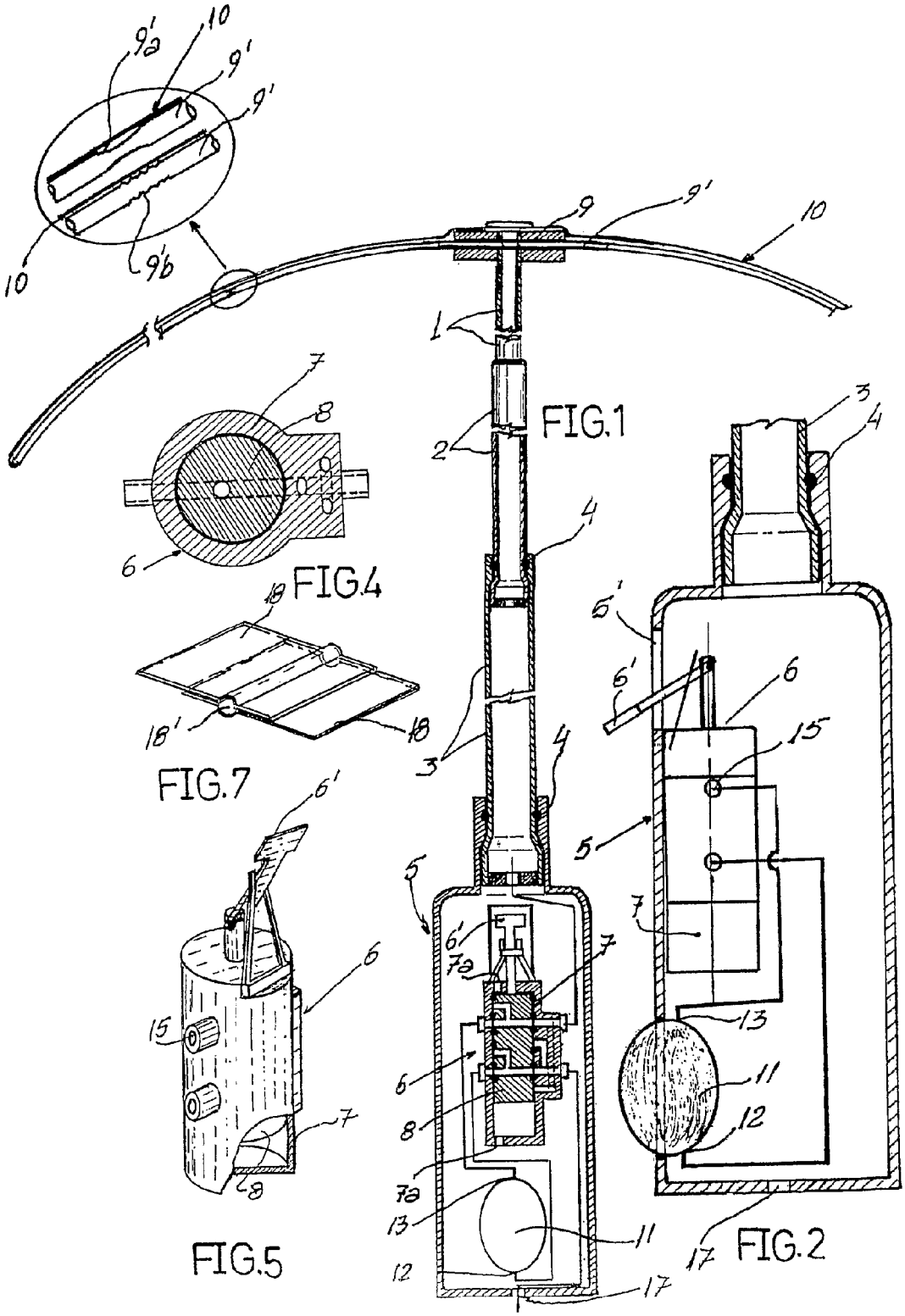
FIG. 1 represents a side elevation view with a partial section of the pneumatic umbrella in a first embodiment.
FIG. 2 represents a detailed view and section of the handle or stem of the umbrella.
FIG. 4 represents a view of a transversal section of the valve that directs the flow of air.
FIG. 5 represents a view in perspective and a section of the valve that directs the flow of air.
FIG. 7 represents a detailed view and section of the upper end of the umbrella in a second embodiment.
Figure 6A:
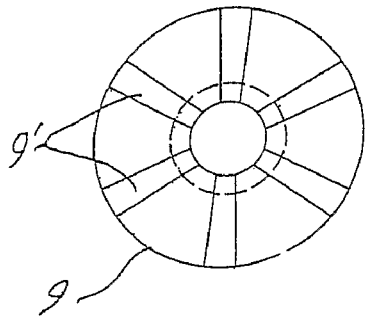
FIGS. 6 and 6*a* represent corresponding views, in side elevation, section and overall of the upper end of the umbrella.

In accordance with the illustration represented in the figures of the drawings, the pneumatic umbrella, in a first embodiment, comprises a pair of tubular portions one encapsulated in the other (1), (2), and (3), provided with respective "0-rings" (4). The tubular portion (3) remains fixed in the hollow body (5) the side wall having a first opening (5') from which a command lever emerges (6') that activates a valve (6) that directs the flow of air, located on the internal surface of the side wall of the hollow body (5). Said valve (6) that directs the flow of air comprises a blank case (7) having at its ends inlet and outlet air orifices (7*a*) defining compensatory conduits. A piston (8) disposed in said case (7) is provided with longitudinal and transversal passages some of which, in the piston's alternative positions, coincide with passages made in the case (7), connected to inlet and outlet air conduits in correspondence with the outside and the tubular sections (1), (2), and (3). The tubular portion (1) is connected to a disc-shaped piece (9) provided with angularly spaced air conduits (9') that allows furling and unfurling of the hemispheric mushroom head (10).

Said disc-shaped piece (9) having an orifice (9*a*), internally threaded which communicates with the air conduits (9'), which is closed by a screw (9*b*), said screw (9*b*) having an "0-ring" (9*b*) located in a vertical groove (9*c*); this system acting as a safety valve releasing air or total deflating the umbrella by unthreading said screw (9*b*).

The behavior of the umbrella in its two operating stages, furled and unfurled, includes steps during the inflation stage, placing the valve (6) that directs the flow of air in the position to inflate. In accordance with FIG. 3*c*, the pneumatic chamber (11) is manually operated like an air pump equipment.

Pressure closes valve (12) and opens valve (13) allowing the air to pass through the valve (6) that directs the flow of air into the tubular portions (1), (2) and (3).

The air travels through inlet passage (14) and outlet (16) and after that, through the disc-shaped piece (9), flowing into the air conduits (9') causing the fabric to unfurl.

When pressure on the manual pneumatic chamber (11) is stopped, the pneumatic chamber goes back to its original position because it is made of a resilient material. Carrying out said maneuver produces a depression within the chamber that closes valve (13) and opens valve (12), connecting with the inlet of air through a hole (17) made in the base of the hollow body (5). Said steps are repeated alternatively until the umbrella is fully unfurled.

Figures 3A, 3B, 3C:
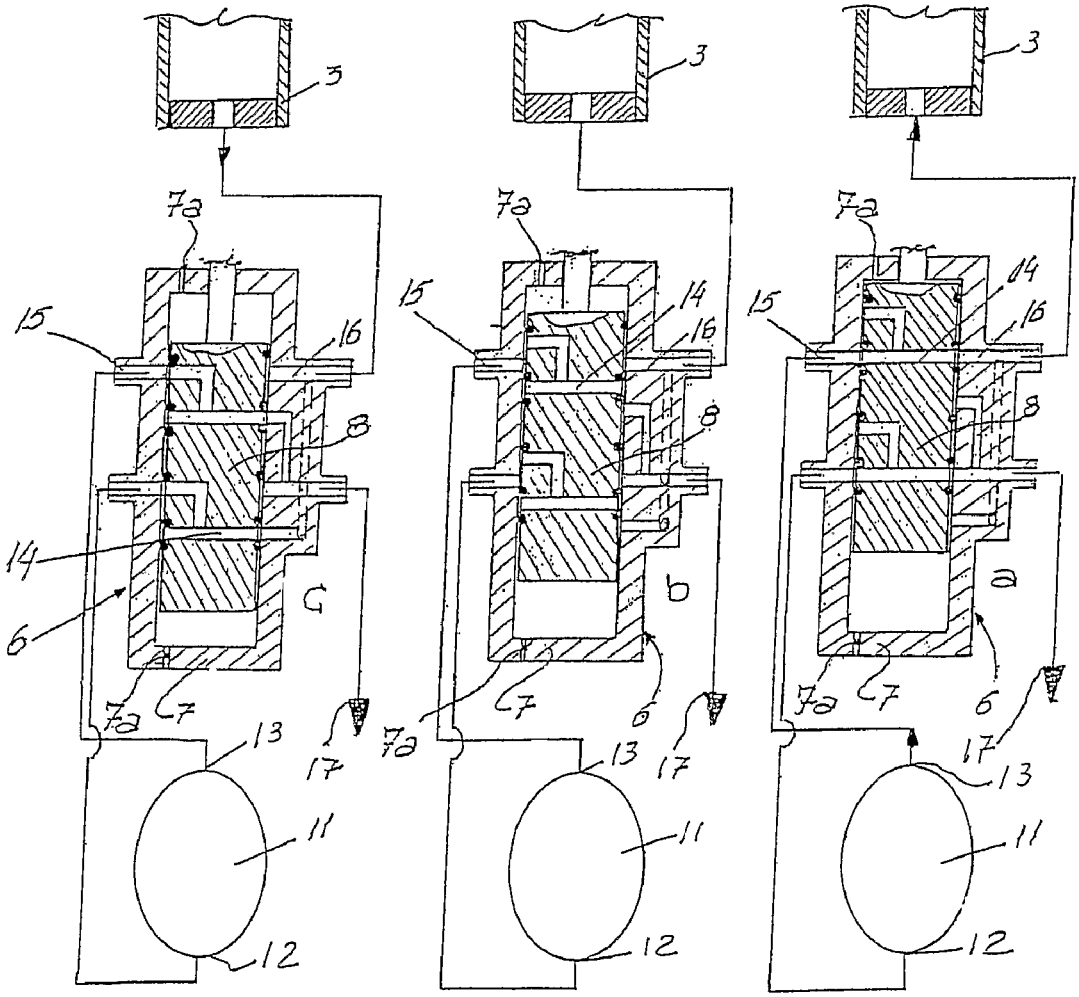
FIGS. 3*a, b,* and *c* represent corresponding longitudinal sections of the valve that directs the air in its three operating positions.

When the unfurling maneuver has finished, the valve (6) that controls the flow of air is in a neutral position, FIG. 3*b*, and the system remains in the inflated state.

At the deflating step, the valve (6) that controls the flow of air is in the position shown in FIG. 3*a*. At this stage, and due to the difference in pressure (greater pressure in the head (10) of the umbrella) the air will flow quite rapidly from the head (10), pass through the directional valve (6) and enter the chamber (11) by open conduit (12), exit via conduit (13), also opened. It passes again through the valve (6) that controls the flow of air and exits through the outlet of orifice (17) located in the lower base of the hollow body (5). When the pressure is balanced (atmospheric pressure) there is no airflow and in order to completely remove remaining air it will be necessary to proceed in an analogous manner to stages (c) and (b) of the process of inflating the system.

It must be emphasized that because of the position of the valve (6) that controls the flow of air when said directional valve expels air, it will flow towards the air outlet orifice (17), and when it is taking air in, the air will enter the circuit formed by the tubular portions (1), (2), (3) and the mushroom-shaped head.

The user will decide the time at which he considers the deflated state to have ended. Then he will again place the valve (6) that controls the flow of air in the neutral position (FIG. 3*b*) and proceed to furl the umbrella.

In a second embodiment, the mushroom-shaped head (10) comprises overlapping cloth panels (18) or similarly comprising radial passages (18').

The hemisphere, or mushroom-shaped head (10), may be manufactured, in accordance with different needs or uses, with conduits of pre-molded flexible plastic tubes 2 to 7 mm crosswise, approximately. Such tubes conform the radial arcs and, possibly, the perimeter of the head itself when the pneumatic system expands. In this case a covering would be adhered to the outer perimeter. That could be accomplished with a single pre-molded plastic sheet, or the like.

Said system of radial arcs, are manufactured with conduits of plastic material that are capable of various degrees of resiliency provided by equally distanced portions having either bellows (9*b*) or tapering (9'*a*) noticeable only when deflated. Those portions allow the umbrella to be folded without the conduits breaking or cracking. When expanded the system will create the resistance required during unftirling when inflated.

The fabric cover being glued or sown to ribs that contain the conduits or directly to the conduits, the fabric forming the outer face.

To hold the mushroom-shaped head steady in strong winds, tensor devices (19') may be attached to the outer perimeter, i.e., at least three of them.

Along its outer edges, the hemisphere, or mushroom-shaped head (10), has reinforcement in the form of guys, the thickness of which may vary as needed, and which serve as a means of stabilization of said hemisphere, or mushroom-shaped portion. The guys are connected directly to the structure of the umbrella.

Figures 6, 8A, 8B, 8C:
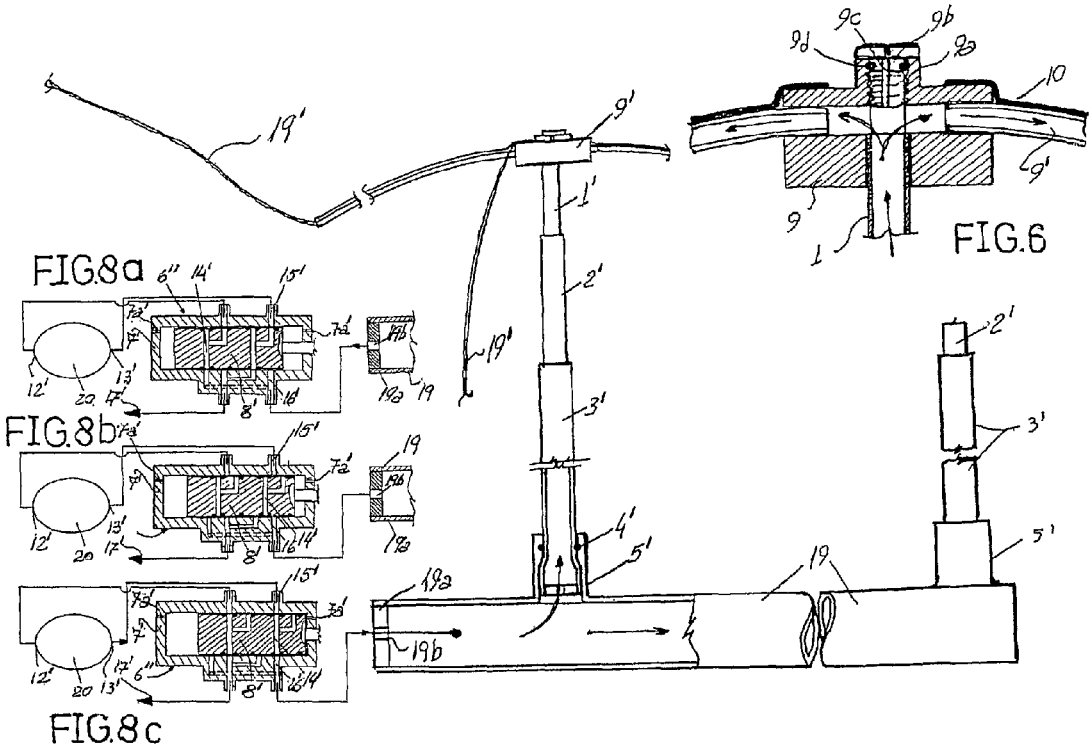
FIGS. 8*a,* 8*b* and 8*c* represent corresponding views, in side elevation and partial section of a third embodiment where at least two intercommunicating umbrellas have been illustrated with the valve that directs the flow of air.

The third embodiment shown in FIGS. 8*a*, 8*b* and 8*c* represents a centralized control, which controls a group of umbrellas by a unified command.

This embodiment comprises encapsulated tubular portions (1'), (2') and (3') provided with respective "O-rings" (4') conforming the mast of the umbrella, joined together through the tubular portion (3'), fixed to the hollow body (5'), to a conduit (19), which is in communication by its end (19*a*), through the orifice (19*b*), to the valve (6") that directs the flow of air as described in the FIGS. 3*a*, 3*b* and 3*c* of the first embodiment, allowing to obtain the same result by inserting an automatic compressor (20) on the outside replacing the pneumatic chamber (11) of the first embodiment.

In this case only one valve (6") that directs the flow of air has been illustrated located outside as represented in FIGS. 8*a*, 8*b* and 8*c*, which acts in the same manner as the valve (6) that directs the flow of air located in the internal part of the umbrella of the first embodiment shown in FIGS. 3*a*, 3*b* and 3*c*.

Figure 9:
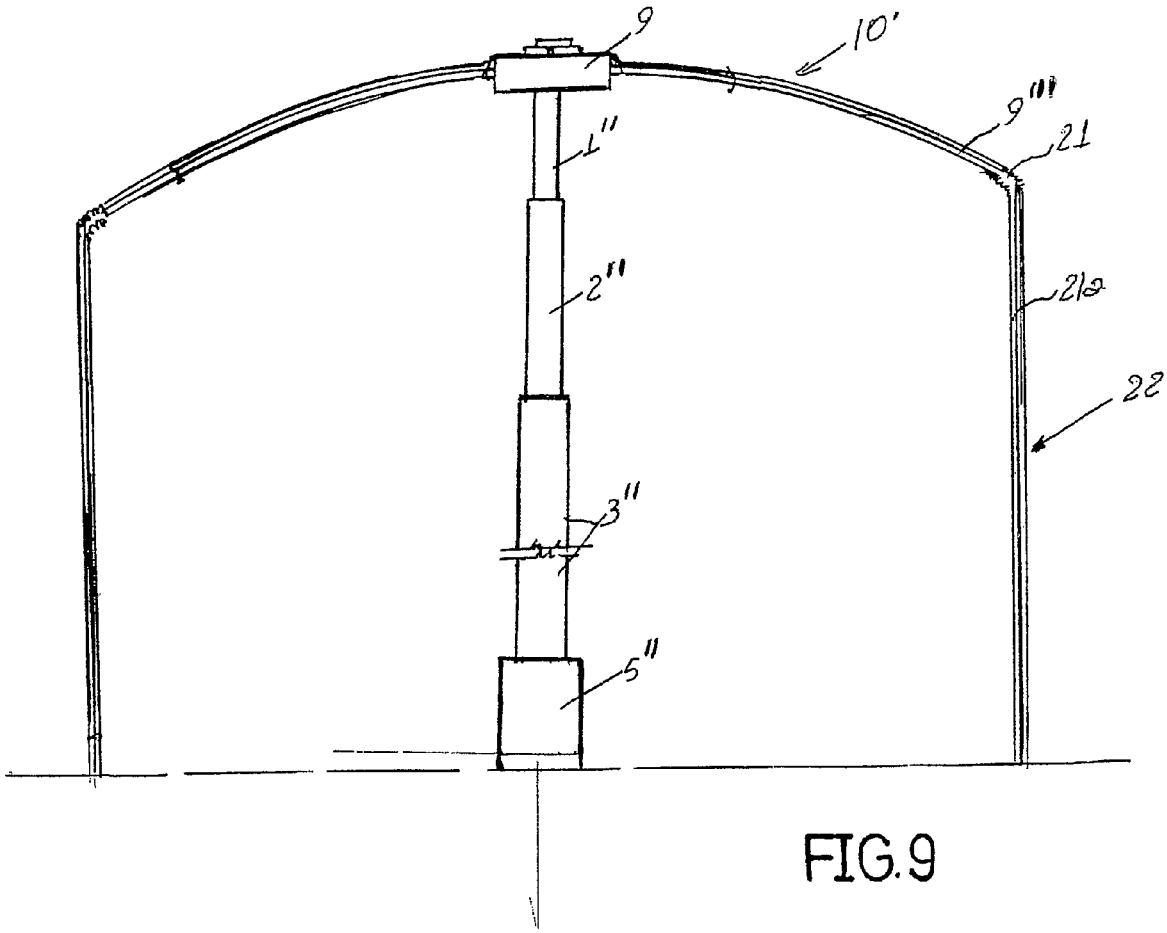
FIG. 9, represents a view of a fourth embodiment in side elevation of the umbrella illustrated in FIG. 1, wherein the size of the mushroom has been extended to conform a concentric covering to said umbrella.

In a fourth embodiment as represented in FIG. 9, the semi sphere or mushroom (10'), having the disc-shaped piece (9"), comprising respective tubular bellows (21) at the ends of the air conduits (9"), which extend in vertical conduits (21*a*) to define a laminar covering (22).

What is claimed is:

1. A group of pneumatic umbrellas comprising:

a plurality of pneumatic umbrellas connected to each other, wherein each pneumatic umbrella comprises: a mast formed by hollow tubular portions encapsulated in one another, the mast having a first end and a second end; a disc-shaped piece connected to the second end of the mast of each umbrella, wherein the disc-shaped piece includes air orifices to furl and unfurl a fabric covering; and a head connected to the disc-shaped piece, wherein the head comprises radial arcs made of a flexible plastic material, wherein the radial arcs include a plurality of orifices having bellows or tapering surfaces;

a longitudinal conduit to connect the plurality of umbrellas, the longitudinal conduit having a first end, a second end, and a plurality of openings, wherein the first end of the mast of one umbrella is inserted on each opening;

a valve to control a flow of air, the valve connected to one end of the longitudinal conduit;

wherein the valve includes a hollow case having an inlet and an outlet air orifices defining compensatory conduits; a piston disposed in the case, the piston having longitudinal and transversal passages;

wherein during the furl of the umbrella, the piston passages coincide with a passage connected to the outlet air orifice directing the flow of air into the mast, the disc-shaped piece, the head, and the radial arc causing the fabric covering to furl; and wherein during the unfurl of the umbrella, the piston passages do not coincide with the passage connected to the outlet air orifice.

2. The group of pneumatic umbrellas of claim 1, wherein the fabric covering comprises overlapping cloth panels having radial passages.

3. The group of pneumatic umbrellas of claim 1, wherein each pneumatic umbrella further comprises a manually operating safety device located where the disc-shaped piece connects with the second end of the mast.

4. The group of pneumatic umbrellas of claim 1, further comprising at least one tensioning device attached to the outer perimeter of the head.

5. The group of pneumatic umbrellas of claim 1, wherein the case is made of a resilient material.

6. A group of pneumatic umbrellas comprising:

a plurality of pneumatic umbrellas connected to each other, wherein each pneumatic umbrella comprises: a mast formed by hollow tubular portions encapsulated in one another, the mast having a first end and a second end; a disc-shaped piece connected to the second end of the mast of each umbrella, wherein the disc-shaped piece includes air orifices to furl and unfurl a fabric covering; and a head connected to the disc-shaped piece, wherein the head comprises radial arcs made of a flexible plastic material, wherein the radial arcs include a plurality of orifices having bellows or tapering surfaces;

a safety valve connected at the connection point between the disc-shaped piece and the second end of the mast of each umbrella;

a longitudinal conduit to connect the plurality of umbrellas, the longitudinal conduit having a first end, a second end, and a plurality of openings, wherein the first end of the mast of one umbrella is inserted on each opening;

a valve to control a flow of air, the valve connected to one end of the longitudinal conduit;

wherein the valve includes a hollow case having an inlet and an outlet air orifices defining compensatory conduits; a piston disposed in the case, the piston having longitudinal and transversal passages;

wherein during the furl of the umbrella, the piston passages coincide with a passage connected to the outlet air orifice directing the flow of air into the mast, the disc-shaped piece, the head, and the radial arc causing the fabric covering to furl; and wherein during the unfurl of the umbrella, the piston passages do not coincide with the passage connected to the outlet air orifice.

* * * * *